US005890470A

United States Patent [19]

Woon et al.

[11] Patent Number: 5,890,470

[45] Date of Patent: Apr. 6, 1999

[54] CONSTANT HORSEPOWER THROTTLE PROGRESSION CONTROL SYSTEM AND METHOD

[75] Inventors: Peter V. Woon; Axel O. zur Loye, both of Columbus, Ind.

[73] Assignee: Cummins Engine Company, Inc., Columbus, Ind.

[21] Appl. No.: 910,335

[22] Filed: Aug. 13, 1997

[51] Int. Cl.[6] ..... F02D 41/00

[52] U.S. Cl. ..... 123/350

[58] Field of Search ..... 123/350, 349, 123/357

[56] References Cited

U.S. PATENT DOCUMENTS

| | | | |
|---|---|---|---|
| 4,047,507 | 9/1977 | Noguchi et al. | 123/32 |
| 4,493,303 | 1/1985 | Thompson et al. | 123/357 |
| 4,708,112 | 11/1987 | Nanjyo et al. | 123/357 |
| 4,711,211 | 12/1987 | Oshizawa et al. | 123/357 |
| 4,914,597 | 4/1990 | Moncelle et al. | 364/426.04 |
| 4,917,063 | 4/1990 | Hiraki | 123/357 |
| 5,174,259 | 12/1992 | Shinzawa | 123/357 |
| 5,261,378 | 11/1993 | Fenchel et al. | 123/501 |
| 5,343,780 | 9/1994 | McDaniel et al. | 477/108 |
| 5,425,338 | 6/1995 | Gottemoller | 123/358 |
| 5,479,898 | 1/1996 | Cullen et al. | 123/350 |
| 5,692,471 | 12/1997 | Zhang | 123/350 |
| 5,692,472 | 12/1997 | Bederna et al. | 123/350 |

*Primary Examiner*—Raymond A. Nelli
*Attorney, Agent, or Firm*—Woodard, Emhardt, Naughton Moriarty & McNett

[57] ABSTRACT

A constant horsepower throttle progression control system and method. In order to improve driveability of a vehicle compared to prior art engine controllers, the present invention operates an engine so as to either produce a constant (or nearly constant) output horsepower at all engine speeds for any throttle position, or so as to produce an output horsepower equal to a predetermined percentage of the range between full rated power and motoring horsepower at all engine speeds for any throttle position. The predetermined percentage may or may not be equal to the percentage of full throttle represented by the throttle position, and may or may not be linearly related thereto.

19 Claims, 6 Drawing Sheets

CONSTANT HORSEPOWER THROTTLE PROGRESSION CONTROL SYSTEM AND METHOD

TECHNICAL FIELD OF THE INVENTION

The present invention generally relates to throttle progression controls and, more specifically, to a constant horsepower throttle progression method.

BACKGROUND OF THE INVENTION

Most prior art engine governors may be classified as either "all-speed" or "min-max" governors. The use of such prior art governors on, for example, diesel engines give inherently poor driveability and throttle feel. The all-speed governors tend to feel strong under light throttle accelerations, but the engine performance severely diminishes as engine speed increases. Min-max governors give increasing engine power as engine speed increases and tend to make the engine feel weak after a transmission shift. Furthermore, the problems of the prior art engine governors are exacerbated when the engines are coupled to automatic transmissions.

Typical constant throttle curves for a diesel internal combustion engine having an all-speed governor are illustrated in FIG. 1. On a typical acceleration from a stop, with an automatic transmission, the driver will typically push the throttle down, for example, about 25%. The driver will think that he or she has requested plenty of throttle because the engine fuel pump will immediately increase to full fuel in order to try to raise the engine speed. If the vehicle does not move, the engine output will drop to about 150 ft-lbs at 1200 r.p.m., as dictated by the torque converter absorption curve 10. As the vehicle starts to move, the engine speed will slowly creep toward 1500 r.p.m., but this may not be enough to convince the automatic transmission to shift to the next gear. Consequently, the driver may need to increase the throttle setting in order to get enough vehicle speed to make the next shift. Unfortunately, the automatic transmission takes this increased throttle position as a desire for a higher shift point and the shift will be even further delayed. When the transmission finally shifts, the engine torque dramatically increases as the speed drops and the stress on the transmission clutches is severe, particularly on the shift into lock-up, where there is no torque converter to soften the impact.

Similar problems exist with the use of a manual transmission, except that the problems mostly center around the ability to get the engine speed high enough at light throttle settings to be able to shift to the next gear. Coming advances in vehicles and transmissions (continuously variable transmissions (CVT), hydrostatic drives and Hybrid vehicles) will further challenge traditional throttle logic. Control systems will need to clearly understand the driver's requirements as the system is optimized for each operating condition.

Typical constant throttle curves for a diesel engine employing a min-max governor are illustrated in FIG. 2. The min-max governor gives basically constant engine torque for any given throttle setting, regardless of engine speed. The problem with this type of prior art governor is that engine output power increases linearly with speed at a constant torque output, so the driver of the vehicle often needs to decrease the throttle setting in order to control acceleration. This may cause a premature shift and the driver will have to increase the throttle setting again after the shift because the output power of the engine has dropped with the engine speed drop. This may then cause the transmission to downshift again, or at least upset the driver, due to the required constant changes in throttle position.

It will therefore be appreciated by those skilled in the art that prior art engine governors exhibit problems related to driveability, throttle feel, and selection of transmission shift points (particularly when used with an automatic transmission). There is therefore a need for a throttle progression control system which does not exhibit the problems with the prior art systems. The present invention is directed toward providing such a throttle progression control system.

SUMMARY OF THE INVENTION

The present invention relates to a constant horsepower throttle progression control system and method. In order to improve driveability of a vehicle compared to prior art engine controllers, the present invention operates an engine so as to either produce a constant (or nearly constant) output horsepower at all engine speeds for any throttle position, or so as to produce an output horsepower equal to a predetermined percentage of the range between full rated power and motoring horsepower at all engine speeds for any throttle position. The predetermined percentage may or may not be equal to the percentage of full throttle represented by the throttle position, and may or may not be linearly related thereto.

In one form of the invention, a method of controlling engine output power is disclosed, comprising the steps of: a) sensing a throttle position selected by an operator of the engine; b) retrieving a predetermined horsepower value associated with the selected throttle position; c) operating the engine substantially at the predetermined horsepower value, regardless of engine speed, at all engine speeds at which the engine is capable of producing the predetermined horsepower; and d) operating the engine at full throttle torque at all engine speeds at which the engine is not capable of producing the predetermined horsepower.

In another form of the invention, a method of controlling engine output power is disclosed, comprising the steps of: a) sensing a throttle position selected by an operator of the engine; b) sensing an engine speed of the engine; c) determining a predetermined percentage associated with said throttle position; d) determining a desired output horsepower as said predetermined percentage of a range comprising a full rated horsepower of the engine minus a motoring horsepower of the engine at said engine speed; and e) operating the engine so as to produce said desired output horsepower.

In another form of the invention, a method of controlling engine output power is disclosed, comprising the steps of: a) sensing a throttle position selected by an operator of the engine; b) sensing an engine speed of the engine; c) determining what percentage of full throttle corresponds to the throttle position; d) retrieving a predetermined percentage associated with the percentage of full throttle determined at step (c); e) determining a desired output horsepower as said predetermined percentage of a range comprising a full rated horsepower of the engine minus a motoring horsepower of the engine at said engine speed; and f) operating the engine so as to produce said desired output horsepower.

In another form of the invention, a method of controlling engine output power is disclosed, comprising the steps of: a) sensing a throttle position selected by an operator of the engine; b) sensing an engine speed of the engine; c) determining a predetermined percentage associated with said throttle position; d) determining a desired output horsepower as said predetermined percentage of a range comprising a full rated horsepower of the engine minus a motoring horsepower of the engine at said engine speed; and e) operating the engine at an operating point that will produce said desired output horsepower.

In another form of the invention, a method of controlling engine output power is disclosed, comprising the steps of: a) sensing a throttle position selected by an operator of the engine; and b) operating the engine at a predetermined, substantially constant horsepower associated with the selected throttle position.

DESCRIPTION OF THE PREFERRED EMBODIMENT

Figure 1:
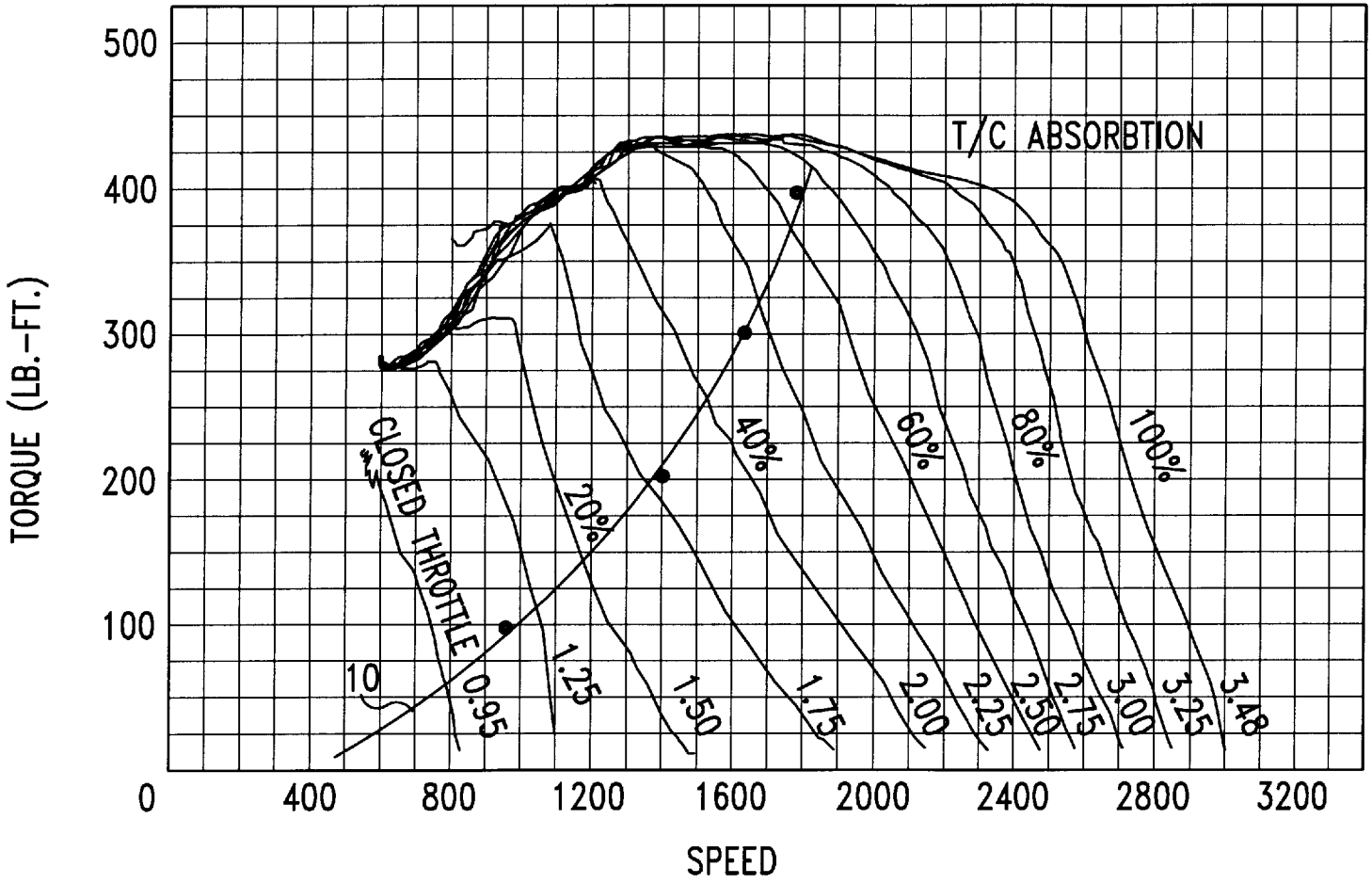
Fig. 1 (PRIOR ART)
FIG. 1 is a graph of torque vs. engine speed for a prior art all-speed governor.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
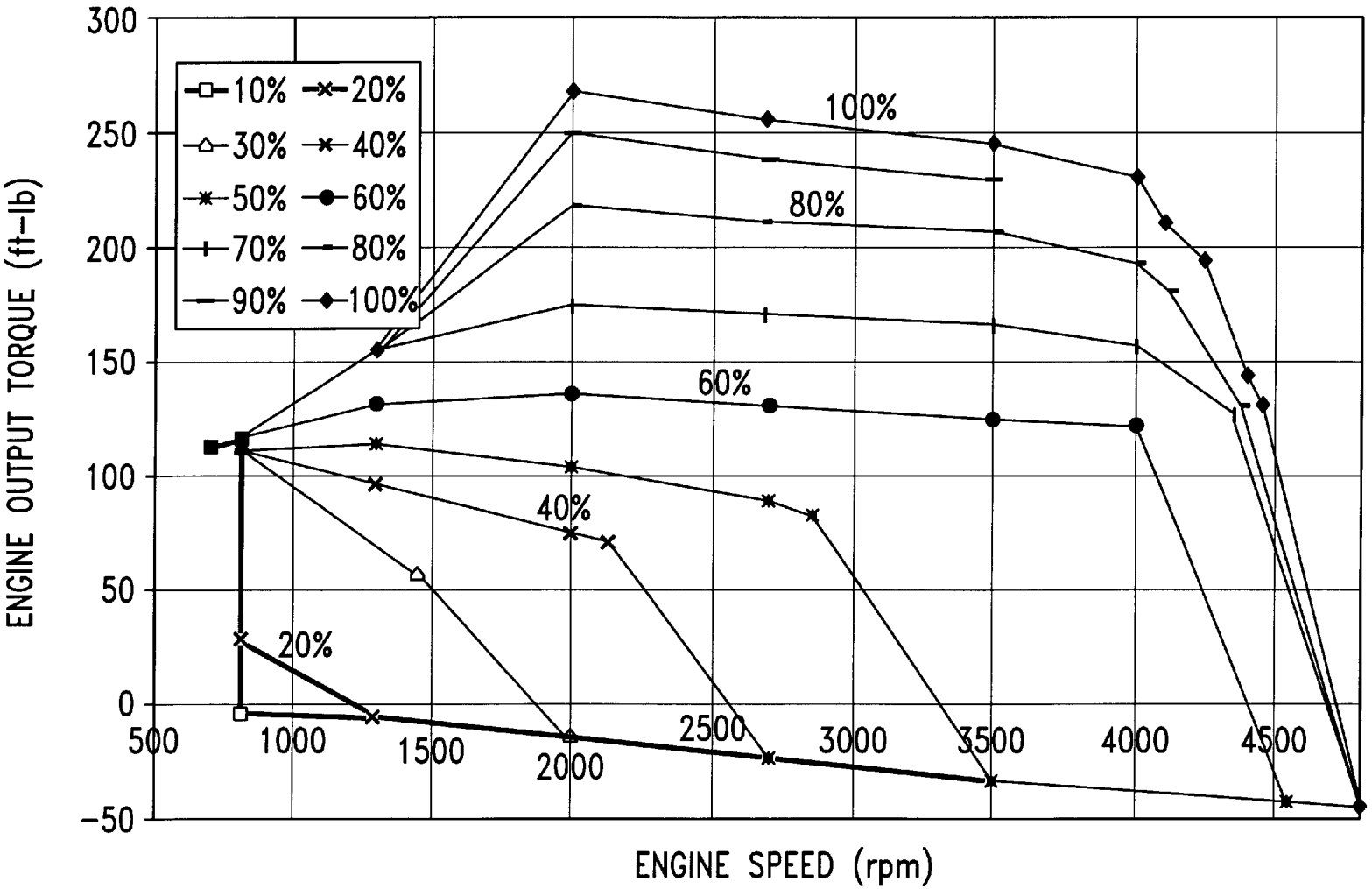
Fig. 2 (PRIOR ART)
FIG. 2 is a graph of torque vs. engine speed for a prior art min-max governor.
Figure 3:
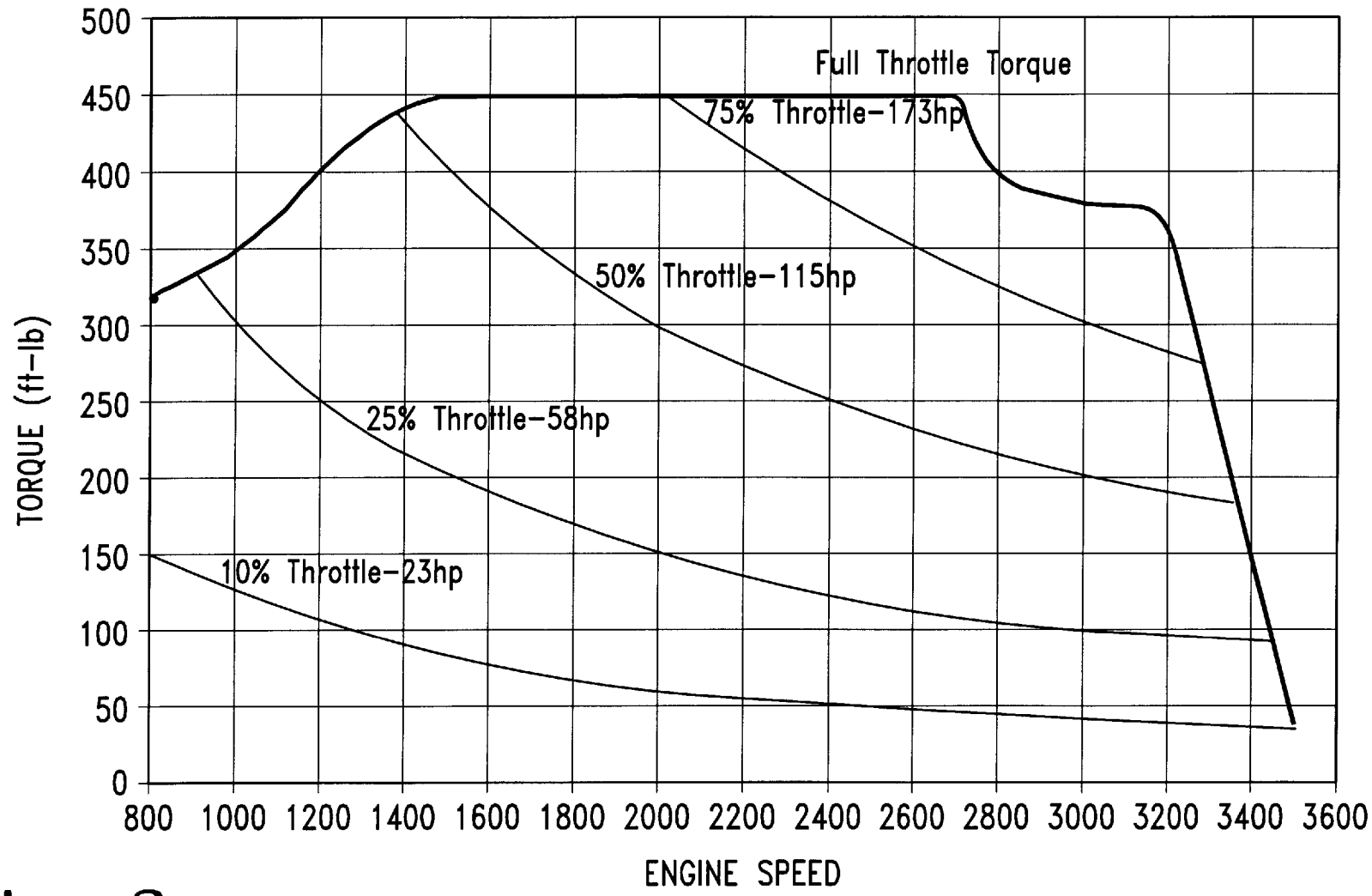
FIG. 3 is a graph of torque vs. engine speed for a first embodiment of the present invention.

FIG. 3 illustrates control curves relating engine output torque and engine speed for a first embodiment of the present invention. The engine governor would be programmed to maintain engine operation on one of the curves, depending upon the amount of throttle requested by the operator of the vehicle. It will be appreciated by those skilled in the art that only a select number of the entire family of curves have been illustrated in FIG. 3 for clarity of illustration. The curves of FIG. 3 illustrate the relationship between engine speed and engine output torque when a constant engine output power (horsepower) is delivered for any particular throttle position, regardless of engine speed. Such a constant horsepower throttle progression falls between the steep slope of the all-speed governor (see FIG. 1) and the flat curves of the min-max governor (see FIG. 2).

As illustrated in FIG. 3, if the driver depresses the throttle 10%, the first embodiment of the present invention interprets this command as a request for a constant engine output power of 23 horsepower, regardless of engine speed. Similarly, a depression of the throttle pedal by 50% is interpreted as a request for a constant engine output power of 115 horsepower. The engine governor will maintain the engine output on the relevant constant horsepower curve except at those engine speeds at which full throttle torque is insufficient in order to reach the constant horsepower curve.

It will be appreciated by those skilled in the art that many of the advantages discussed herein may be obtained by programming the controller to maintain substantially constant (rather than exactly constant) horsepower including, but not limited to, horsepower that only varies within a narrow range (for example, less than ±25%), substantially constant horsepower over a portion of the total engine speed range, substantially constant horsepower over a portion of the load range, substantially constant horsepower after vehicle accessory loads are accounted for, substantially constant horsepower as a percentage of maximum motoring horsepower to full rated horsepower, etc.

The constant horsepower throttle progression curves of FIG. 3 represent an improvement over the prior art governors, in that use of the constant horsepower throttle progression results in the engine and the transmission control systems both easily understanding exactly what the driver is expecting in terms of performance. On a part-throttle acceleration, the transmission could be programmed to shift as soon as the engine speed after the shift would allow the engine to produce the same output power. When the driver depresses the throttle to accelerate, the transmission will shift when the engine is not capable of producing the desired power.

One potential problem with using the constant horsepower throttle progression curves of FIG. 3 without further governor control is that very light throttle positions will take the engine to high idle, making shifting difficult with manual transmissions. This results because the engine is unloaded at idle, and any small throttle request from the driver will result in the engine producing more power than is required to overcome its own internal friction. This results in an acceleration of engine speed and engine speed will keep climbing to the point where the governor is programmed to cut fuel to the engine. Any small throttle input from the driver at idle will therefore take the engine to an undesirably high speed.

A further problem with using the constant horsepower throttle progression curves of FIG. 3 is that at engine speeds above idle, the driver must use the throttle to modulate engine output between motoring (coasting, no fuel to engine) to full power, not just from no-load (idle) to full power.

As an example, suppose that a vehicle is travelling at 55 mph on level ground and requires 30 hp to maintain this constant speed. The throttle position will therefore be set (either by the driver or by the cruise control system) to a position at which 30 hp is requested from the engine. If the vehicle encounters a downhill slope having an increasing grade, the horsepower output from the engine which is required to maintain the 55 mph speed continues to drop to the point where the brakes would have to be applied if the vehicle were in neutral. When this point is reached, it is desirable to use the motoring horsepower (the friction of the engine) to slow down the vehicle before applying the brakes. In such a scenario, the driver would slowly ease off the throttle until a no-load condition was reached (engine idling—no net torque) and only enough fuel was being supplied to the engine to overcome its own friction. If further deceleration were required, the driver would remove his foot from the throttle pedal, at which point no fuel would be supplied to the engine (motoring—the vehicle is pushing the engine). While motoring, the friction of the engine is used to slow the vehicle. When the downhill grade decreases or is removed altogether, then the opposite sequence of throttle positions will be commanded.

Figure 4:
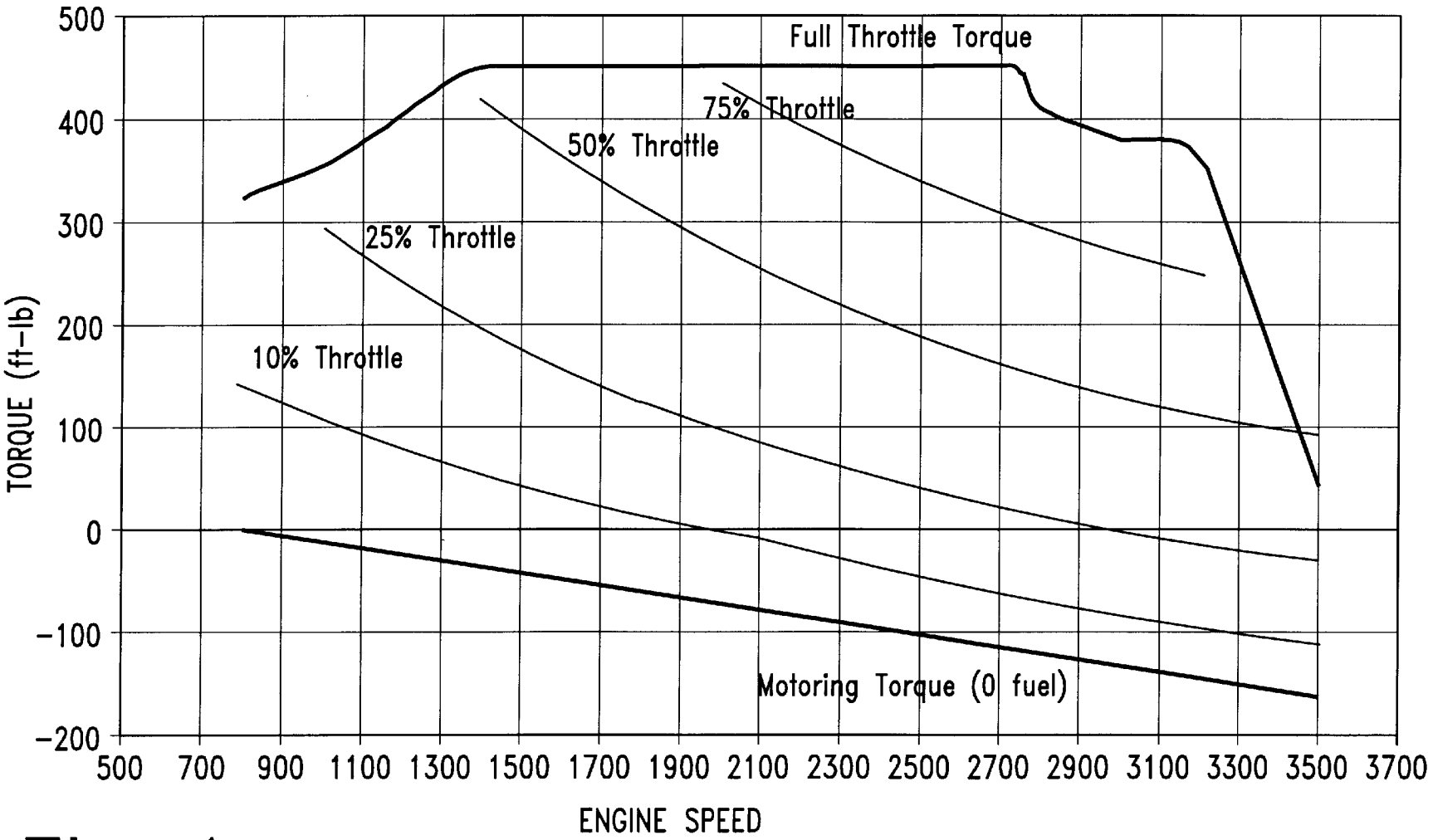
FIG. 4 is a graph of torque vs. engine speed for a second embodiment of the present invention.

It is desirable to have a smooth transition between motoring, no-load, and full power. When using the constant horsepower throttle progression curves of FIG. 3, there is an abrupt step when moving from 0% throttle (motoring) to a command of 1 horsepower. This abrupt step function can result in an undesirable jarring feel to the driver, especially when using a manual transmission. In order to alleviate this problem, the second embodiment of the present invention, as illustrated in FIG. 4, utilizes a modified constant horsepower throttle progression. In the second embodiment, application of the throttle while motoring does not result in abrupt step and consequently there is no unpleasant feel to the driver. In the second embodiment, the throttle therefore selects between the motoring horsepower at the current engine speed and full rated power. This allows control of no-load engine speed and improves the transition from motoring after a coast down.

A controller operating according to the second embodiment throttle progression curves of FIG. 4 will allow the engine to maintain a motoring condition when 0% throttle is requested and will command full rated power when 100% throttle is requested. However, between these two extremes, the controller will operate the engine at a predetermined percentage of the difference between full rated power and the motoring horsepower at the current engine speed. For example, suppose the current engine speed is 2100 r.p.m., that motoring horsepower at this speed is −30 horsepower and full rated power is 230 horsepower. The difference between full rated power and the motoring horsepower at the current engine speed is 260 horsepower. If 25% throttle is commanded while the engine is motoring, the controller will calculate a predetermined fraction, for example 25%, of the 260 horsepower difference, which is 65 horsepower. We therefore want to set the output horsepower at 25% of the full range between motoring and full rated power, or 65 horsepower from the bottom of this range. Since the bottom of the range (at this engine speed) is −30 horsepower, the output horsepower must be set 65 horsepower above −30 horsepower, or at 35 horsepower. The 25% throttle curve of FIG. 4 is calculated in this manner for all engine speeds, and the controller will maintain the engine operation on this curve at any engine speed as long as the throttle remains at 25%.

It will be appreciated by those skilled in the art that such a curve will not maintain the output at a constant horsepower. This is because the output horsepower is calculated as a fraction of the difference between full rated power and the motoring horsepower at any engine speed, and the motoring horsepower becomes greater (a greater negative horsepower) at higher engine speeds. It will be further appreciated by those skilled in the art that the predetermined fraction need not be linear with the commanded throttle percentage. In other words, a throttle command of 25% need not necessarily result in a horsepower output of 25% of the difference between full rated power and motoring horsepower, but instead may result in a horsepower output of, for example, 50% of the difference, or any other fraction.

A third embodiment of the present invention is to use the throttle progressions of FIG. 3 or 4, but rather than selecting the constant horsepower at the engine output, the governor could control the output power at the output shaft of the transmission, or even at the drive wheels. It is only necessary to provide the engine/transmission controller with a simple model of the drivetrain and the throttle can be used to command horsepower at any point in the drivetrain.

Figure 5A:
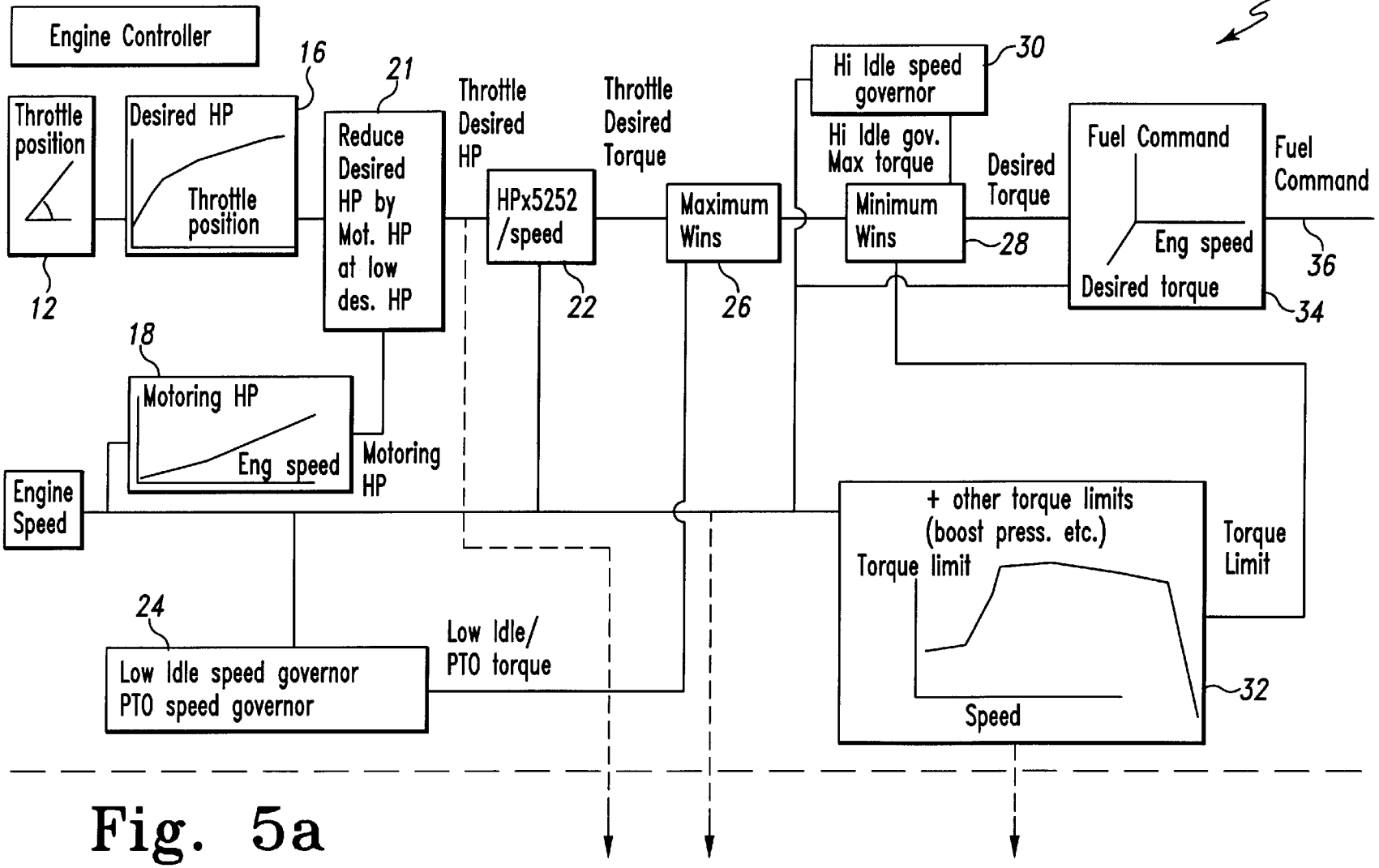
FIG. 5 is a schematic block diagram of a first embodiment engine and transmission controller of the present invention.
Figure 5B:
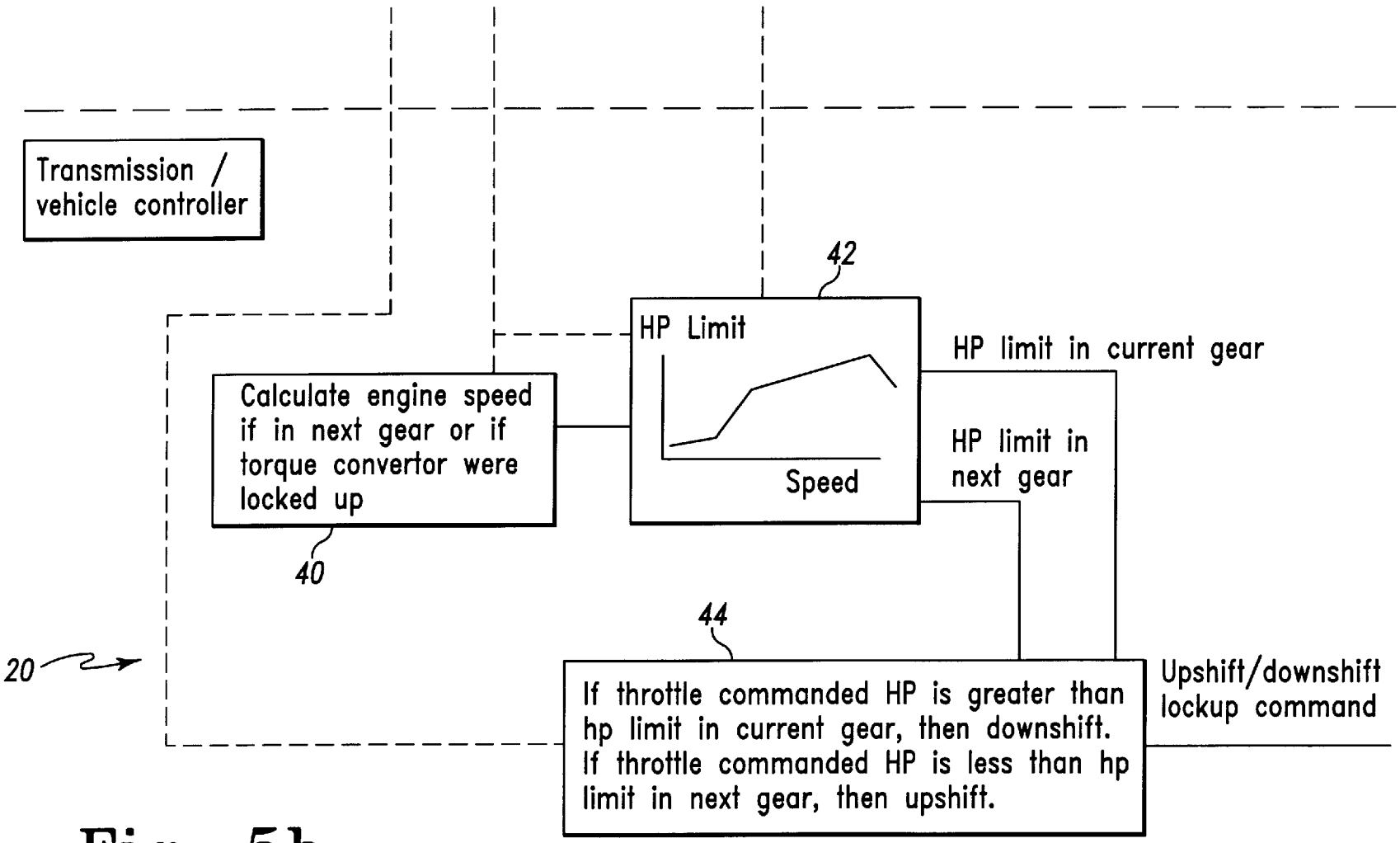

Referring now to FIG. 5, there is illustrated a schematic block diagram of a first embodiment engine controller 10 and transmission/vehicle controller 20 of the present invention. The controller 10, 20 may be used to implement the throttle progression curves disclosed hereinabove with reference to FIG. 4. The engine controller 10 receives input from a throttle position sensor 12 and an engine speed sensor 14. The current throttle position from the sensor 12 is input to the function block 16, which determines the desired horsepower fraction for the current throttle position. This is the horsepower calculated hereinabove with respect to FIG. 4 prior to adjustment for the motoring horsepower. The motoring horsepower for the current engine speed is determined at function block 18. Both of the function blocks 16 and 18 may be implemented by any convenient means, such as by a look-up table in a computer memory. The outputs of the function blocks 16 and 18 are input to the function block 21, which reduces the desired horsepower fraction determined at block 16 by the motoring horsepower determined at block 18. The output of block 21 is therefore the desired output horsepower. This desired output horsepower is input to the block 22 which converts this value to the desired torque value.

The output of the engine speed sensor 14 is additionally input to block 24, which comprises the low idle speed governor and the power take off speed governor. The block 24 basically sets a lower threshold upon the torque that may be requested from the engine in order to avoid attempting to run the engine at such a low speed that it will not idle. Block 26 selects the maximum commanded torque from either the block 22 or the block 24 and inputs this value to the block 28. Another input to the block 28 comes from the high idle speed governor 30. Finally, a third input to the block 28 comes from the torque limiting block 32, whose output is the full rated torque of the engine at the current engine speed. The block 28 selects the minimum value from its three inputs and passes this value to the block 34. A second input to the block 34 comes from the engine speed sensor 14. The block 34 contains a map of the throttle progression curves of FIG. 4 as they relate to fuel commands to the engine. The block 34 therefore determines the fuel command 36 to be sent to the engine based upon the desired torque and the current engine speed.

The transmission/vehicle controller 20 of FIG. 5 works in conjunction with the engine controller 10 in order to control the vehicle's transmission. The block 40 calculates the resulting engine speed if the next gear in the transmission were to be selected or if the torque converter were locked up. This value is input to the function block 42 along with the current engine speed and the maximum torque limit from the block 32. The block 42 determines the upper horsepower limit for any given engine speed for any gear, and produces two outputs which indicate the horsepower limit in the current gear and the horsepower limit in the next gear. These values are input to the function block 44, along with the desired horsepower value which is output by the function block 21. The function block 44 will produce a signal instructing the transmission to downshift if the commanded throttle horsepower is greater than the horsepower limit in the current gear. The function block 44 will further instruct the transmission to upshift if the throttle commanded horsepower is less than the horsepower limit in the next gear.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

The throttle progressions disclosed in the present invention are not limited to a linear relationship between the throttle position and the requested horsepower. Furthermore, those skilled in the art will recognize that the invention disclosed herein is also applicable to spark ignition and other engines where the engine throttle is not connected directly to the driver's throttle, and to other forms of transmissions, such as CVTs, hydrostatic transmissions, etc.

What is claimed is:

1. A method of controlling engine output power, comprising the steps of:

a) sensing a throttle position selected by an operator of the engine;

b) retrieving a predetermined horsepower value associated with the selected throttle position;

c) operating the engine substantially at the predetermined horsepower value, regardless of engine speed, at all engine speeds at which the engine is capable of producing the predetermined horsepower; and d) operating the engine at full throttle torque at all engine speeds at which the engine is not capable of producing the predetermined horsepower.

2. The method of claim 1, wherein the operator of the engine is an automatic cruise control system.

3. The method of claim 1, wherein the predetermined horsepower value is an engine output horsepower.

4. A method of controlling engine output power, comprising the steps of:

a) sensing a throttle position selected by an operator of the engine;

b) sensing an engine speed of the engine;

c) determining a predetermined percentage associated with said throttle position;

d) determining a desired output horsepower as said predetermined percentage of a range comprising a full rated horsepower of the engine minus a motoring horsepower of the engine at said engine speed; and e) operating the engine so as to produce said desired output horsepower.

5. The method of claim 4, wherein the operator of the engine is an automatic cruise control system.

6. The method of claim 4, wherein the predetermined percentage is equal to a percentage of full throttle represented by the throttle position.

7. The method of claim 4, wherein the predetermined percentage is linearly related to a percentage of full throttle represented by the throttle position.

8. The method of claim 4, wherein the desired output horsepower is an engine output horsepower.

9. A method of controlling engine output power, comprising the steps of:

a) sensing a throttle position selected by an operator of the engine;

b) sensing an engine speed of the engine;

c) determining what percentage of full throttle corresponds to the throttle position;

d) retrieving a predetermined percentage associated with the percentage of full throttle determined at step (c);

e) determining a desired output horsepower as said predetermined percentage of a range comprising a full rated horsepower of the engine minus a motoring horsepower of the engine at said engine speed; and f) operating the engine so as to produce said desired output horsepower.

10. The method of claim 9, wherein the operator of the engine is an automatic cruise control system.

11. The method of claim 9, wherein the predetermined percentage is equal to a percentage of full throttle represented by the throttle position.

12. The method of claim 9, wherein the predetermined percentage is linearly related to a percentage of full throttle represented by the throttle position.

13. The method of claim 9, wherein the desired output horsepower is an engine output horsepower.

14. A method of controlling engine output power, comprising the steps of:

a) sensing a throttle position selected by an operator of the engine;

b) sensing an engine speed of the engine;

c) determining a predetermined percentage associated with said throttle position;

d) determining a desired output horsepower as said predetermined percentage of a range comprising a full rated horsepower of the engine minus a motoring horsepower of the engine at said engine speed; and e) operating the engine at an operating point that will produce said desired output horsepower.

15. The method of claim 14, wherein the operator of the engine is an automatic cruise control system.

16. The method of claim 14, wherein the predetermined percentage is equal to a percentage of full throttle represented by the throttle position.

17. The method of claim 14, wherein the predetermined percentage is linearly related to a percentage of full throttle represented by the throttle position.

18. The method of claim 14, wherein the desired output horsepower is an engine output horsepower.

19. A method of controlling engine output power, comprising the steps of:

a) sensing a throttle position selected by an operator of the engine; and b) operating the engine at a predetermined, substantially constant horsepower associated with the selected throttle position.

* * * * *